US007674356B2

(12) United States Patent
Karlsson et al.

(10) Patent No.: US 7,674,356 B2
(45) Date of Patent: Mar. 9, 2010

(54) PAPER MACHINE BELT

(75) Inventors: Kjell Anders Karlsson, Oerebro (SE); Vaeinoe Per-Ola Lidar, Hoegsjoe (SE)

(73) Assignee: Voith Fabrics Patent GmbH, Heidenheim (DE)

( * ) Notice: Subject to any disclaimer, the term of this patent is extended or adjusted under 35 U.S.C. 154(b) by 462 days.

(21) Appl. No.: 11/560,432

(22) Filed: Nov. 16, 2006

(65) Prior Publication Data

US 2007/0084029 A1 Apr. 19, 2007

Related U.S. Application Data

(60) Division of application No. 10/921,908, filed on Aug. 20, 2004, now abandoned, which is a continuation-in-part of application No. PCT/GB03/00824, filed on Feb. 24, 2003.

(30) Foreign Application Priority Data

Feb. 23, 2002 (GB) ..... 0204308.1

(51) Int. Cl.

| | |
|---|---|
| ***D21F 2/00*** | (2006.01) |
| ***B32B 7/08*** | (2006.01) |
| ***B32B 5/06*** | (2006.01) |
| ***B32B 3/30*** | (2006.01) |
| *D21F 3/02* | (2006.01) |

(52) U.S. Cl. ..... 162/306; 162/358.4; 162/901; 28/110; 442/275

(58) Field of Classification Search ..... 162/116, 162/348, 358.1, 358.2, 361, 900–904, 306, 162/358.4; 442/270, 275; 28/110, 142
See application file for complete search history.

(56) References Cited

U.S. PATENT DOCUMENTS

| | | | | |
|---|---|---|---|---|
| 4,271,222 | A | 6/1981 | Hahn | |
| 4,283,454 | A | 8/1981 | Buchanan | |
| 4,382,987 | A | 5/1983 | Smart | |
| 4,446,187 | A * | 5/1984 | Eklund | 428/136 |
| 4,500,588 | A | 2/1985 | Lundstrom | |
| 4,772,504 | A * | 9/1988 | Andresen | 428/96 |
| 4,781,967 | A * | 11/1988 | Legge et al. | 428/109 |
| 4,851,281 | A * | 7/1989 | Wood | 442/225 |
| 5,194,121 | A * | 3/1993 | Taguchi et al. | 162/358.1 |
| 5,298,124 | A | 3/1994 | Eklund et al. | |
| 5,713,396 | A | 2/1998 | Lee | |
| 6,036,819 | A * | 3/2000 | Miller et al. | 162/358.2 |
| 6,071,837 | A * | 6/2000 | Crook | 442/268 |
| 6,140,260 | A * | 10/2000 | Johnson et al. | 442/270 |
| 6,383,339 | B1 * | 5/2002 | Gstrein | 162/358.4 |
| 6,514,386 | B2 * | 2/2003 | Watanabe | 162/358.2 |
| 6,712,940 | B2 * | 3/2004 | Crook | 162/306 |

(Continued)

FOREIGN PATENT DOCUMENTS

| | | |
|---|---|---|
| DE | 2126331 | 12/1972 |

(Continued)

*Primary Examiner*—Eric Hug
(74) *Attorney, Agent, or Firm*—Greenblum & Bernstein P.L.C.

(57) ABSTRACT

A paper machine belt that includes at least one layer having parallel yarns. Additionally, a ratio of a volume of the parallel yarns in the at least one layer to a void volume in the at least layer is greater than 1:1.

8 Claims, 4 Drawing Sheets

U.S. PATENT DOCUMENTS

| | | | | |
|---|---|---|---|---|
| 2002/0060045 | A1* | 5/2002 | Watanabe | 162/358.1 |
| 2002/0060058 | A1 | 5/2002 | Crook | |
| 2003/0051848 | A1* | 3/2003 | Watanabe | 162/358.2 |
| 2004/0154776 | A1* | 8/2004 | Inoue | 162/358.1 |
| 2005/0081570 | A1 | 4/2005 | Karlsson et al. | |
| 2005/0124248 | A1* | 6/2005 | Hyvonen | 442/268 |

FOREIGN PATENT DOCUMENTS

| | | | |
|---|---|---|---|
| EP | 0285376 | | 10/1988 |
| EP | 0473969 | | 12/1994 |
| EP | 1085124 | | 3/2001 |
| EP | 1127976 | | 8/2001 |
| WO | WO 98/21403 | * | 5/1998 |
| WO | 9941447 | | 8/1999 |
| WO | 0127387 | | 4/2001 |
| WO | 03071030 | | 8/2003 |

* cited by examiner

Invention

PAPER MACHINE BELT

CROSS-REFERENCE TO RELATED APPLICATIONS

The present application is a divisional application of U.S. application Ser. No. 10/921,908, filed on Aug. 20, 2004, which is a Continuation in Part of International Application No. PCT/GB03/00824, filed Feb. 24, 2003 and claims priority of Great Britain Patent Application No. 0204308.1, filed on Feb. 23, 2002. Moreover, the disclosure of U.S. application Ser. No. 10/921,908, filed on Aug. 20, 2004, International Patent Application No. PCT/GB03/00824 filed Feb. 24, 2003 and International Patent Application No. PCT/GB03/00830 filed Feb. 24, 2003 are expressly incorporated by reference herein in their entireties.

BACKGROUND OF THE INVENTION

1. Field of the Invention

The present invention relates to paper machine belts and particularly, but not exclusively, to paper machine process belts such as belts for transferring and/or smoothing the paper web within, to and/or from the press section of a paper machine.

2. Discussion of Background Information

Transfer belts are used for carrying a paper web through a portion of a paper machine so as to eliminate open draws in which the paper web is unsupported and is thus likely to break. When the web breaks, the paper machine must be shut down and consequently this constitutes a serious problem to the papermaker. Such transfer belts tend to have a smooth surface which can aid smoothing of the paper sheet and provide an extremely uniform pressure distribution in the nip with no basecloth mark.

The belt surface should also provide for release of the paper web from the belt. In the paper machine, the paper web tends to remain adhered to smooth belt surfaces via a film of water, which forms between the web and the belt. For web release to be achieved, this continuous film of water needs to be broken. Prior art belts, which facilitate ready sheet release, have utilized polymeric coating layers impregnated with a fibrous or particulate material such that the fibers or the particles are exposed on the web-receiving surface of the belt to modify the belt's surface characteristics.

One transfer belt of this type is described in U.S. Pat. No. 5,298,124. Here, the sheet release post transfer is assisted by incorporating particles, which under pressure are compressed into the belt matrix, but on release of pressure at the web release point, stand proud of the belt surface and thus create a temporary roughening of the surface which aids sheet release. The transfer belt includes a woven base structure, which results in pronounced marking of the paper sheet.

U.S. Pat. No. 4,500,588 relates to a conveyor felt including one or more fibrous batt layers needled on a woven support fabric as well as a filling material filling the support fabric and the fiber batt layers with the exception of the surface facing the web. The surface of the felt is calendered. The woven base fabric results in marking of the paper web.

In EP 1127976 a transfer belt includes a base support having a layer of thermoplastic material formed thereon. A batt of fibrous material is located on top of this thermoplastic material. The whole structure is then heated in order to allow the thermoplastic material to migrate to the surface. This produces a polymeric surface with embedded fibers, which can assist with the controlled separation of the paper sheet and the belt. The woven base fabric results in marking of the paper sheet.

In EP 1085124 a transfer belt includes a polymeric resin matrix mixed with a fibrous or particulate material. One of the matrix or the fibrous/particulate materials is hydrophobic. The paper web-receiving face of the transfer belt is polished to expose the fibers/particles. This arrangement suffers from the drawback that the fibers/particles are unlikely to be uniformly mixed with the resin or uniformly orientated within the resin. Thus, on polishing, the degree of exposure of the fibrous/particles at the web-receiving surface will be non-uniform. Again, the woven base fabric results in marking of the paper sheet.

SUMMARY OF THE INVENTION

According to a first aspect of the present invention there is provided a paper machine belt including at least one layer of parallel yarns, wherein a ratio of a volume of the yarns in the one layer to the void volume in the layer is greater than 1:1.

In a preferred embodiment of the invention the ratio is greater than 1.5:1 and ideally is substantially 2:1.

The aforesaid parallel yarns in the one layer preferably extend in either the cross machine direction (cd) or machine direction (md).

The parallel yarns provide a supporting structure with approximately half the amount of spacing between adjacent yarns as a typical prior art woven base structure. This is because the strength of the belt in the machine-direction and cross-machine direction is not provided by a set of md yarns woven into and between the cd yarns, but instead the strength in the machine direction and cross-machine direction is provided by two separate layers of material.

Ideally one of the supporting layers includes cd yarns and another includes md yarns. The layer providing cd strength is ideally made up of multi-strand (e. g. multifilament or cabled) cd yarns, which are laid in close proximity to one another. However, in order to give ease of handling, the cd yarns will preferably be loosely bound together with very fine md yarns. For example, the md yarn diameter may be in the order of 0.1 mm and selected for pliability, compared to the relatively stiff cd yarns with a diameter of approximately 0.5 mm.

As the md yarns are so fine, the cd yarns may be placed in close proximity to each other. Only very fine knuckles are created (the fine md yarns crimping rather than the relatively stiff cd yarns). These knuckles would be virtually unnoticeable in the finished product. The ratio of the mass of the cd yarns to md yarns is ideally substantially at least 160:1. The whole layer providing cd strength preferably has a weight of approximately 200 g/m$^2$. Ideally, this layer includes approximately 9 to 15 yarns/cm, preferably 10 or 11 yarns/cm.

The belt may include one or more separate layers of bat fibers, at least one of the layers ideally being provided on the paper web-receiving side of the supporting layer. The batt is needled to the other layers of the belt so as to mechanically inter-lock them together as well as providing the desired surface topography. The batt used preferably has a weight in the range from 50 to 800 g/m$^2$ and ideally in the order of 300 g/m$^2$.

A first layer of polymeric material is ideally provided on the paper web receiving face of the belt. A further layer of polymeric material is preferably provided on the obverse side of a supporting layer to the first polymeric layer. The layers of polymeric material preferably have a Shore hardness in the range from 30A to 75D, and ideally have a hardness of substantially 90 Shore A.

The weight of each polymeric material layer is ideally approximately 400 g/m$^2$. The thickness of each layer of the polymeric material is ideally in the range from 0.4 to 1.0 mm. Thermoplastic polymeric material is preferred, such as polyether based polyurethane.

In addition, as stated previously, the belt may include a further supporting layer, to be needled on the paper machine roll side of the structure, to provide strength and stability in a direction generally perpendicular to the other supporting layer. This further supporting layer ideally provides md strength and may be in the form of a woven, knitted or molded membrane, for example of the type described in EP 0285376. However, this further supporting fabric ideally include an array of strong, stable, spirally wound, machine direction yarns.

Layers of fibrous batt can also be needled into the base fabric, in order to hold the yarns in position, to provide a coherent structure and also facilitate wear resistance. In a preferred embodiment, the machine roll side layer is made up of spirally wound, machine direction, 0.2 mm/2 ply/2 cabled, polyamide yarns, with approximately 7 to 12 yarns/cm. There is approximately 200-600 g/m$^2$ of needle punched polyamide batt fiber in the range of 3 to 67 dtex. This whole layer preferably has a weight in the range from 450 to 480 g/m$^2$.

The spirally wound layer of md yarns with batt needled thereon is a preferred supporting substrate as the marking due to cross-over knuckles in conventional woven substrate is eliminated. Also, the yarns are encased in a fibrous batt structure, which dampens out the pressure points.

It was found that the cd oriented yarn structure embedded between the layers of thermoplastic polymer, further to heat treatment and calendering, results in a laminated product with much improved macro-level pressure uniformity, due to the fact that there was far less chance of sheet marking, as is typical of present woven substrates with pronounced warp knuckles.

The inherent smoothness of the paper-web receiving side of the belt, although reducing sheet marking, exhibits relative poor web release after passing through the press nip. This problem is dealt with by another aspect of the present invention.

According to a second aspect of the present invention there is provided a method of making a paper machine belt having a paper-web receiving surface and an obverse face thereto, the belt including a supporting base, a fibrous batt and at least one layer of polymeric material, the polymeric material being provided on the paper web-receiving surface of the belt, wherein the method includes the step of needling the belt structure, from the obverse face, such that fibrous batt is pushed at least partially through the polymeric material.

The method of the invention may be used to produce paper machine transfer belts having uniformly orientated and distributed fibers extending through the polymeric layer. This ordered distribution of the fibers provides for reliable sheet release.

According to a third aspect of the present invention there is provided a paper machine belt including a supporting base, a fibrous batt and at least one layer of polymeric material on the paper web-receiving surface of the belt, wherein a plurality of fibers from the fibrous batt extend at least partly through the layer of polymeric material.

In a preferred embodiment of the invention at least some of the plurality of fibers extend at least to the web-receiving surface of the polymeric material.

As stated previously, the method of the invention includes the step of needling the belt structure with needles. A certain number of these needle punches are directed from the inside (paper machine roll-side) of the laminate towards the outside (paper web surface), which leave individual batt fibers and possibly needle-exit, surface distortions in the surface polymer layer. The web-receiving surface of the product includes relatively large flat areas with isolated disturbances from the fibrous material protruding through the polymeric material. Desirably from 1 to 200 per square cm, and preferably 10 to 100 per square cm of fibers project through to the web-receiving surface of the belt.

The belt preferably has a surface roughness ($S_a$) of 80 μm or less as measured with a contact stylus profilometer (SurfaScan SJ (g), Somicronic, France).

The stylus has a radium of 2 μm and an angle of 90 degrees. An area of 5×5 mm should be recorded with 10 scans per mm each measurement being evaluated. Prior to the surface roughness describing parameters being calculated, any deviations are separated with a digital Gaussian filter of size 0.8 mm.

The surface roughness is numerically described with $S_a$ [1], which is an arithmetic average of the height deviation from the mean plane.

$$S_a = \frac{1}{MN}\sum_{j=1}^{N}\sum_{i=1}^{M}|z(x_i, y_i)| \quad [1]$$

The surface effect may be varied by using special bat fibers, which can help to create finer, isolated surface disturbances. Examples of these include, microfibrilatable fibers, such as Lyocell (D, or core/sheath bicomponent fibers which split into finer segments.

The benefit of the complex surface topography, exhibited by the belts of the invention, is that there are enough non-planar elements to break the water film between the wet paper sheet and the belt on the paper machine thus providing good sheet release when the two are required to part company. However, it is noted that there are not enough surface disturbances, nor are these large enough, to significantly effect the wet sheet at the press, and the very smooth plane between the surface disturbances are sufficient to improve sheet smoothness.

It is noted that the preferred unique laminate structure of the invention remains water-impermeable despite these surface disturbances, as there are separate interior layers of polymer that have been melted and sealed by nip compression, so that no continuous channels exist to permit the flow of water there through.

The needling process may be repeated, as required. Once needling is complete, the belt may then be "thermoformed"; i.e. heat is applied to the belt, which has the affect of melting the polymeric material. Immediately after passing under the heat source, whilst the polymeric material is still in a semi-molten state, the belt is passed through a nip against a smooth roll.

This compression consolidates the belt and provides the smooth surface. The fibrous matter on the surface will obviously be compressed by the nipping, but the polymeric material is, on the whole, not molten enough to envelope the fibers. Generally speaking, a chilled roll would be used, although a similar effect may be achieved with a steel belt or synthetic belt with or without cooling. The temperature at which this operation takes place would generally be less than 180° C.

During one preferred method of belt manufacture, sheets of thermoplastic material, such as polyurethane, are placed on top of the belt and cd yarn layers and because of this, there is inherently an equal mass of polymer across the surface.

The thermoplastic layer is then partially melted and passed through the nip such that the surface is formed under pressure. Due to local pressure in the region of the yarns, the polymer tends to move to the free space between the yarns, resulting in there being physically more material in this free space than in the region directly above a yarn. In fact, undulations are visible in the uncompressed belt.

This occurs because the movement of thermoplastic material has occurred during formation under pressure and when this pressure is released, the elasticity of the thermoplastic material allows the belt to return to its natural state. Then, when the belt is running on a paper machine, pressure is applied in the nip, some of this pressure being used to compress bulges in the belt to a flat state, at which point all of the belt then compresses further in unison so that there are no high or low pressure points. It is a combination of this specialized method of manufacture and the cross-machine direction supporting structure that give the superb non-sheet marking.

A highly polished roll, such as a chrome roll would provide a smooth surface. However, in a preferred embodiment of the invention the smooth roll surface contains microscopic sized striations, these striations becoming impressed onto the belt surface. The striations, like the fibrous material extending through the polymeric layer, aid the belt's ability to sheet release. The belt surface could also be buffed, polished or sanded using well-known technology, or 'flame treated' to produce unusual topographic smoothness and/or texture.

The total belt thickness is normally between 2.4 and 3.2 mm with an average weight of between 2600 and 3300 g/m$^2$.

The preferred structure of the invention includes at least five main layers, which working from bottom to top include:

1) a supporting structure providing machine-direction stability,
2) a thermoplastic film or films
3) a structure providing cross-machine stability,
4) a fibrous batt, and
5) further thermoplastic film or films, wherein the mass of thermoplastic material of layer (2) is preferably substantially the same as that in layer (5) to minimize edge-curl.

The whole structure is consolidated through needling, at various stages during the manufacturing process. Further to the needling process, the entire structure is then exposed to sufficient thermal energy to cause any lower melt point, thermoplastic, polymeric films to melt. This melted polymer from both layers bonds the structure together, embedding the upper cd orientated yarn layer and part of the batt in a matrix of molten polymer and forms a very smooth and well defined, impermeable surface, which is resistant to delamination. The belt is then smoothed with a cold polished cylinder.

In an alternative preferred structure the order of layers"1" and"2" hereinbefore described is swapped around, such that the structure comprises at least five main layers, which working from bottom to top include:

1) a thermoplastic film or films,
2) a supporting structure providing machine-direction stability,
3) a structure providing cross-machine stability,
4) a fibrous batt, and
5) further thermoplastic film or films, wherein the mass of thermoplastic material of layer (1) is preferably substantially the same as that in layer (5) to minimize edge-curl. Such an arrangement helps to prevent batt loss and assists with ease of cleaning.

Yet another aspect of the invention includes a paper machine belt that includes at least one layer having parallel yarns. Additionally, a ratio of a volume of the parallel yarns in the at least one layer to a void volume in the at least layer is greater than 1:1. Additionally the ratio can be greater than 1.5:1. Also, the ratio is substantially 2:1. Moreover, the parallel yarns can extend in a cross machine direction. Additionally, the parallel yarns can extend in a machine direction. Moreover, the parallel yarns extending in the cross machine direction can be multi-strand yarns. Also, the parallel yarns can comprise an array of spirally wound machine direction yarns. Moreover, the belt further can include at least one layer of batt. Also, the belt can include at least one layer of polymeric material. Moreover, one of the at least one layer of polymeric material can be positioned on a face of the belt and structured and arranged to support a paper web. The paper machine belt can further include a supporting base, a fibrous batt, and at least one layer of polymeric material on a paper web-receiving surface of the belt. A plurality of fibers from the fibrous batt can extend at least partly through the at least one layer of polymeric material.

Another aspect of the invention includes a paper machine belt includes a supporting base, a fibrous bat, and at least one layer of polymeric material on a paper web-receiving surface of the belt. The machine also includes a plurality of fibers from the fibrous batt extend at least partly through the at least one layer of polymeric material. Moreover, at least one of the plurality of fibers can extend to the web-receiving surface of the polymeric material. The belt can have 1 to 200 fibers per square cm that can extend through the layer of polymeric material. Moreover, the belt can have a surface roughness of 80 μm or less as measured with a contact stylus profilometer. Also, the batt fibers can include at least one of microfibrillatable fibers or core/sheath bicomponent fibers.

Yet another aspect of the present invention includes a method of making a paper machine belt having a paper-web receiving surface and an obverse face thereto, the belt comprising a supporting base, a fibrous batt and at least one layer of polymeric material, the polymeric material being provided on the paper web-receiving surface of the belt. The method includes needling the belt, from the obverse face, such that fibrous batt is pushed, at least partially, through the polymeric material. Moreover, the belt can be thermoformed after the needling is complete. Additionally, the belt can be calendered immediately after being thermoformed. Also, a paper machine belt can be produced by the above-noted method. Moreover, The method can further include providing at least one layer having parallel yarns with a ratio of a volume of the parallel yarns in the at least one layer to a void volume in the at least layer is greater than 1:1.

BRIEF DESCRIPTION OF THE DRAWINGS

In order that the present invention may be more readily understood a specific embodiment thereof will now be described by way of example only with reference to the accompanying drawings in which.

DETAILED DESCRIPTION OF THE PRESENT INVENTION

Figure 1:
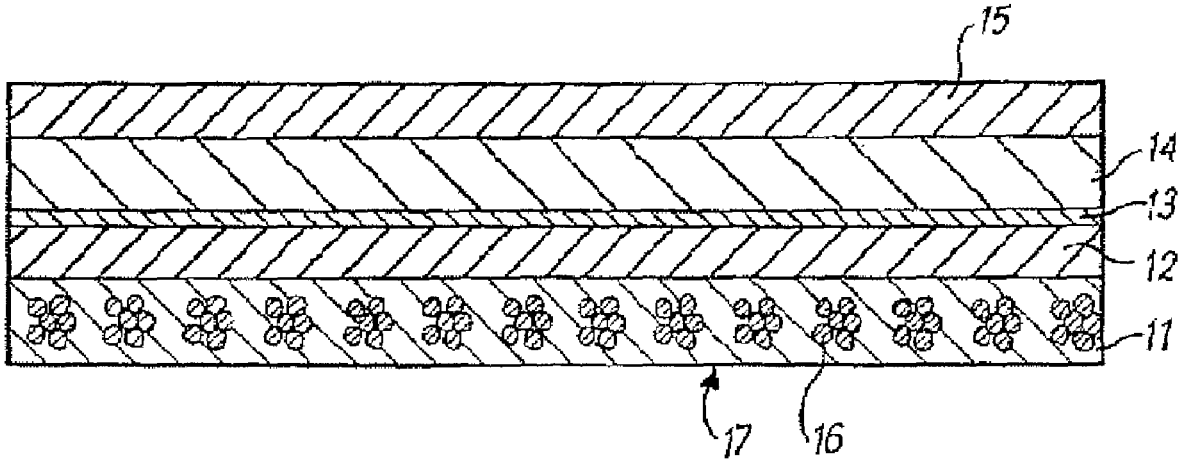
FIG. 1 is a diagrammatic cross-section through a transfer and smoothing belt in accordance with the present invention.

Referring to FIG. 1 a transfer and smoothing belt 17 for use in the press section of a paper machine includes an endless loop having five layers 11-15.

The supporting layer includes spirally wound md yarns 16 into which batt has been needled to hold the yarns 16 in position. In this embodiment, the md yarns include three pairs of yarns twisted together.

The second layer 12, located on layer 11, itself includes two individual layers of thermoplastic polyurethane having a weight of 400 g/m$^2$ and being 0.5 mm thick. It is noted that during the later heating stage these two polyurethane layers, a single homogeneous layer is formed which bonds and partially impregnates the supporting fabric 11 and the adjacent upper layer 13.

Layer 13 includes a quasi-non-woven structure made up of cabled cd yarns and extremely fine md yarns, for loosely holding the cd yarns in position.

This layer has a weight of approximately 200 g/m$^2$. The mass of material ratio of cd yarns to md yarns is approximately 160:1. This layer provides cd strength and rigidity.

A layer 14 of batt is located above the cabled cd structure 13 to facilitate inter-locking of the various layers by needling. The batt material preferably has a weight in the order of 300 g/m$^2$.

The final layer 15 of thermoplastic material is ideally identical to the inner thermoplastic material layer 12 and is tacked in place by needling. This results in a series of isolated surface disturbances at the web-receiving side of the final layer 15.

On heating, the constituent low melt polyurethane layers flow and bond the structure together, embedding the top cd yarn layer 13 and part of the batt 14, in a polymeric matrix. The belt is cured at a surface temperature of around 200° C. with a dwell time of 5 minutes. It is then calendered at 1 to 40 KN/m at a temperature of less than 180° C. The structure is preferably formed as an endless tube, although the structure may comprise a seam.

A surprising surface benefit was realized by needle punching the laminate structure of the invention. The needle punch process forces the batt fibers to penetrate the polymeric material; more particularly, the metal needle violently punctures the film, while a bundle of fibers are carried in the barb of the needle through the puncture. As the needle is retracted, a portion of the fibers remain in the puncture, held by friction and the points of the serrations created.

From recent in-house trials on a pilot machine it has been found that the belt described above gives excellent transfer at speeds of up to 2000 m/min.

Figure 2:
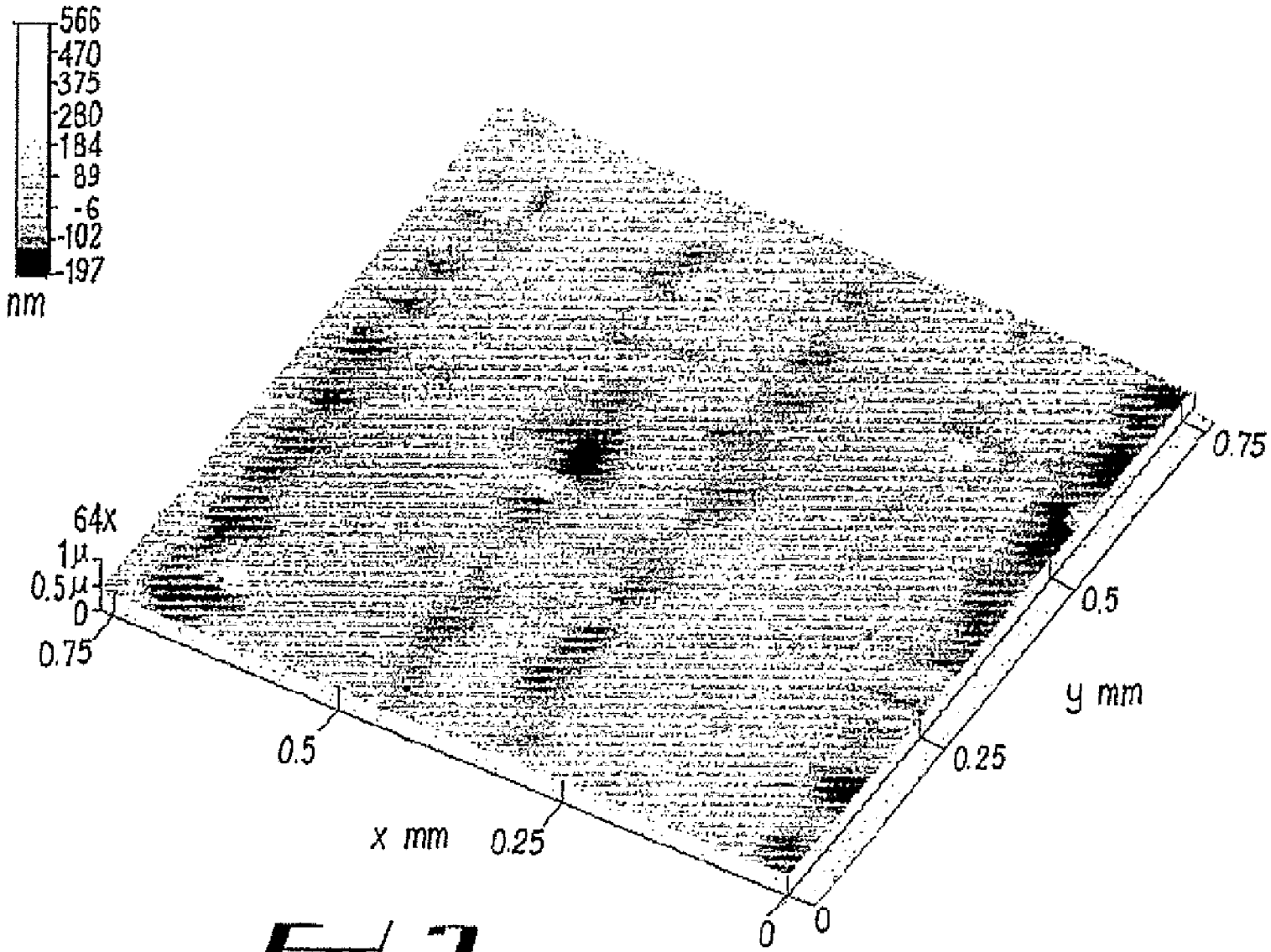
FIG. 2 is an image of the surface topography of the belt of the type shown in FIG. 1.

With reference to FIG. 2 as a result of the curing process to melt the polymeric layers, and the subsequent compressive calendering to consolidate the molten polymer with the other layers, an interesting surface phenomenon was found, in that a high percentage of the surface was extremely planar and smooth, with only slight machine-direction striations present, resulting from the roll surface preparation contacted the molten surface.

The needling operation tends also to result in the formation of cavities. These are created when the needle tears through the film. The surface distortions caused by the tears again aids web release.

Figure 3:
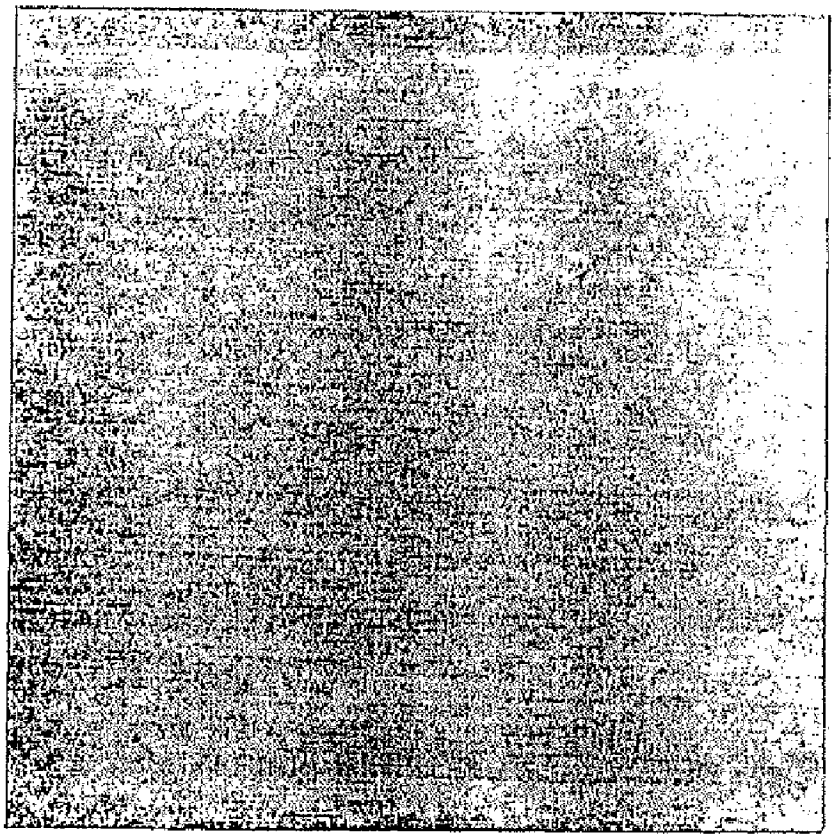
Prior Art FIG. 3
FIG. 3 is an image showing the carbon impression of the belt of the type shown in FIG. 1 compared with a prior art belt.
Figure 3:
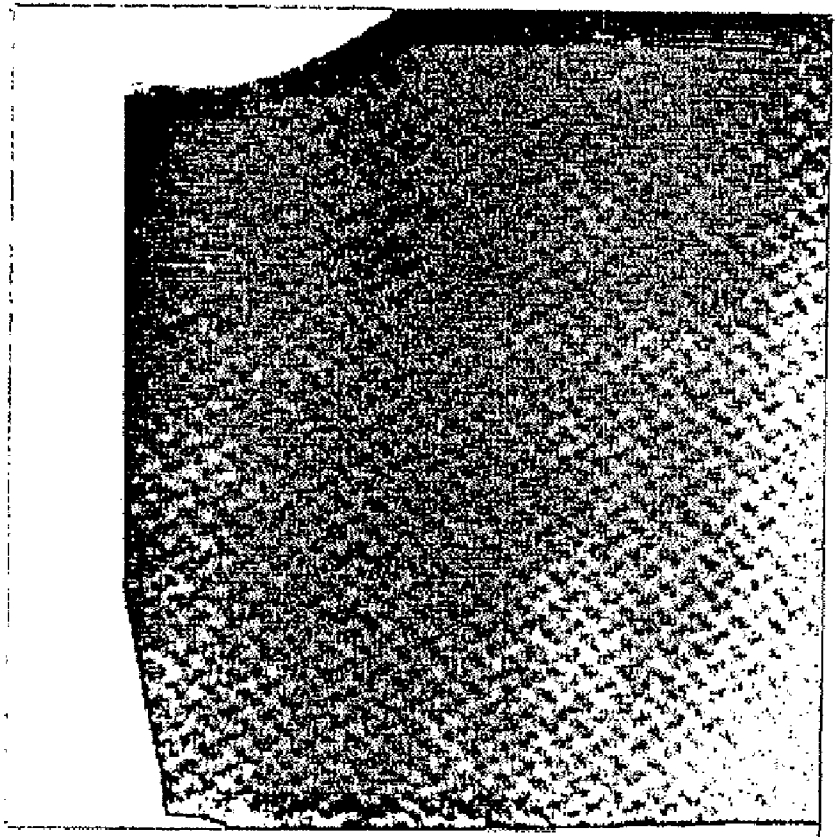
Prior Art FIG. 3

With reference to FIG. 3 nip impressions made under pressures typical of a paper machine press demonstrate superior pressure uniformity of this invention relative to a conventional belt made by applying a coating on top of a woven substrate. FIG. 3 shows carbon impressions of a prior art belt in comparison to one of the present invention. It shows very clearly that the belt of the present invention has a much smoother surface.

Figure 4:
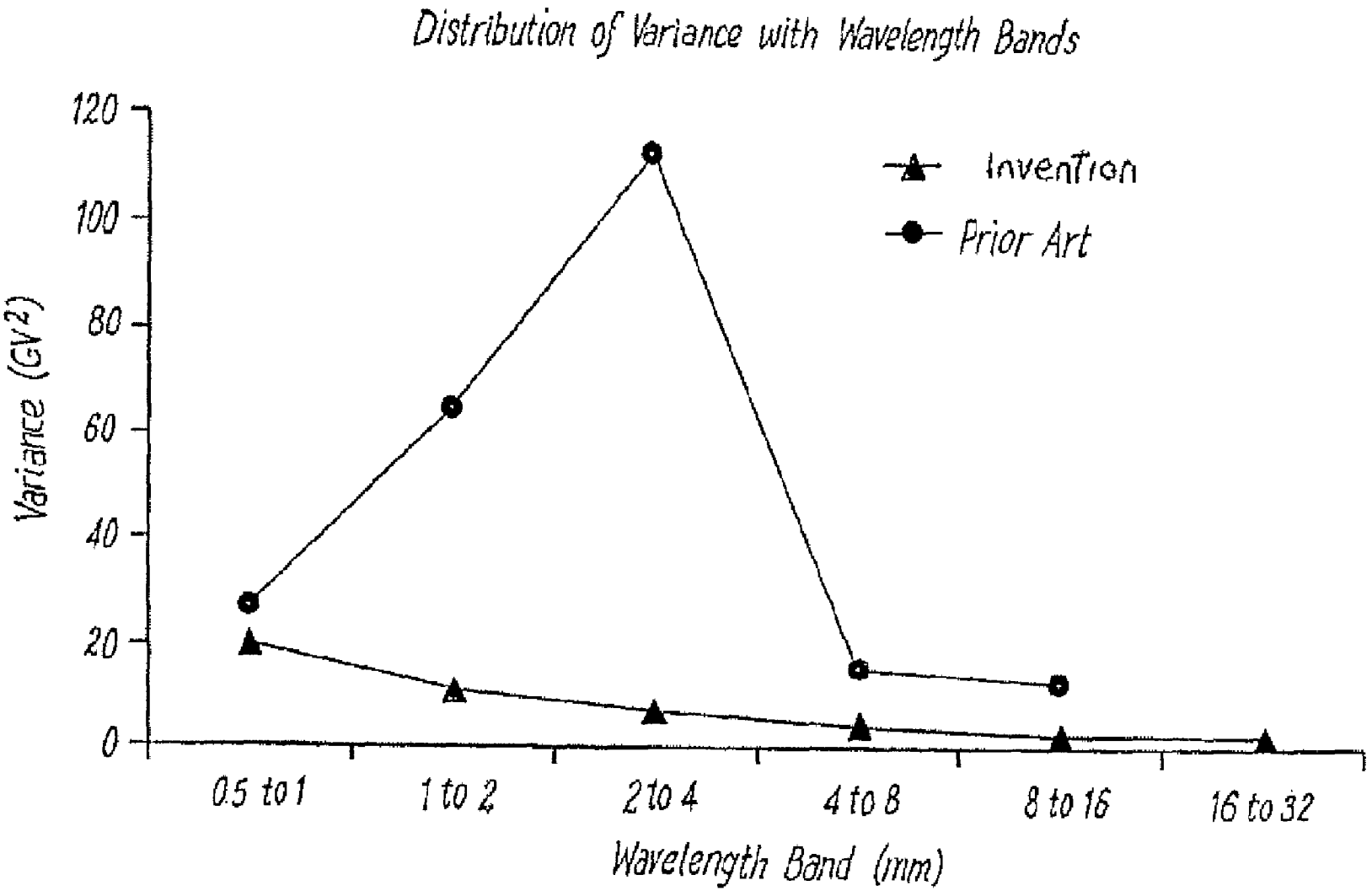
FIG. 4 is a graph showing the distribution of Variance with Wavelength Bands for the belt of the type shown in FIG. 1 in comparison with a prior art belt.

FIG. 4 is a graph showing the Variance versus the Wavelength band. This establishes that the flatter and lower the distribution, the smoother the sheet. The graph shows overall that the belt of the present invention has a smoother surface with a low frequency, dispersion of matter on the surface, the surface area of which is small; i.e. fibrous. It can be seen that the prior art belt has a higher periodicity in that there is a much more frequent distribution of surface matter with a higher surface area; i.e. particulate matter.

An additional unexpected advantage of belts of the invention is their superior abrasion resistance compared to the leading prior art belt. This can be seen from the Martindale Abrasion test results set out below. These were measured using the Martindale Abrasion Tester on the same testing head against standard sandscreen abraidant and pressure of 600 g. The thickness (in mm at 0.4 kg/cm$^2$) has been measured both initially and during testing.

| | Sample Prior Art Smoothing Belt | Belt of the Invention |
|---|---|---|
| Original | 3.08 | 4.19 |
| After 5000 cycles | 2.94 | 4.12 |
| After 10000 cycles | 2.82 | 4.08 |
| After 15000 cycles | 2.72 | 4.05 |
| After 20000 cycles | 2.62 | 4.02 |
| Total Thickness loss (mm) | 0.46 | 0.17 |
| Percentage thickness lost (%) | 14.9 | 4.1 |

It is to be understood that the above-described embodiment is by way of illustration only. Many modifications and variations are possible. The polymeric material, for example, does not necessarily need to be thermoplastic. A thermoset could also be used, although a thermoplastic is preferred. Any number of polymeric film layers can be provided in the structure in any given location. The polymer need not necessarily be applied as a film. Furthermore, it does not need to be impermeable. The polymeric material may comprise polymer coated yarns, layers of particles in a paste or strips of non-woven material.

What is claimed:

1. A method of making a paper machine belt having a paper-web receiving surface and an obverse face thereto, the belt comprising a supporting base, a fibrous batt and at least one layer of polymeric material, the polymeric material being provided on the paper web-receiving surface of the belt, the method comprises:

needling the belt, from said obverse face, such that fibrous batt is pushed, at least partially, through said polymeric material; and varying a number of penetrating fibers into the paper web-receiving surface of the belt to between 1 to 200 fibers per square centimeter.

2. The method according to claim 1, wherein the belt is thermoformed after the needling is complete.

3. The method according to claim 2, wherein the belt is calendered immediately after being thermoformed.

4. The method according to claim 1, further comprising:

providing at least one layer having parallel yarns, wherein a ratio of a volume of said parallel yarns in said at least one layer to a void volume in said at least layer is greater than 1:1.

5. The method according to claim 1, wherein the belt is cured at a surface temperature of around 200° C. with a dwell time of 5 minutes.

6. The method according to claim 1, further comprising calendering the belt at 1 to 40 KN/m at a temperature of less than 180° C.

7. The method according to claim 1, wherein the needled batt fibers are uniformly oriented.

8. The method according to claim 1, wherein the needling results in formation of cavities.

* * * * *